United States Patent [19]

Okubo et al.

[11] Patent Number: 4,571,287

[45] Date of Patent: Feb. 18, 1986

[54] ELECTROLYTICALLY PRODUCING ANODIC OXIDATION COAT ON AL OR AL ALLOY

[75] Inventors: Keigo Okubo, Shiojiri; Shoji Toba, Matsumoto; Tokuo Kumagai, Suwa, all of Japan

[73] Assignees: Nagano Prefecture, Nagano; Kabushiki Kaisha Chiyoda, Tokyo, both of Japan

[21] Appl. No.: 582,148

[22] Filed: Feb. 24, 1984

Related U.S. Application Data

[63] Continuation-in-part of Ser. No. 308,099, Oct. 2, 1981, abandoned.

[30] Foreign Application Priority Data

Dec. 27, 1980 [JP] Japan ..... 55-184995
Dec. 27, 1980 [JP] Japan ..... 55-184996

[51] Int. Cl.[4] ..... C25D 11/14; C25D 11/22

[52] U.S. Cl. ..... 204/37.6; 204/42; 204/58; 204/DIG. 9

[58] Field of Search ..... 204/35.1, 37.6, 58, 204/42, DIG. 9

[56] References Cited

U.S. PATENT DOCUMENTS

| | | | |
|---|---|---|---|
| 3,708,407 | 1/1973 | Newman et al. | 204/56 |
| 3,717,555 | 2/1973 | Chakravarti et al. | 204/35 N |
| 3,870,608 | 3/1975 | Mita | 204/58 |
| 3,892,636 | 7/1975 | Kaneda et al. | 204/35 N |
| 3,930,966 | 1/1976 | Takahashi et al. | 204/58 |
| 3,935,084 | 1/1976 | Terai et al. | 204/58 |
| 4,046,649 | 9/1977 | Elco et al. | 204/58 |
| 4,478,689 | 10/1984 | Loch | 204/14.1 |

FOREIGN PATENT DOCUMENTS

| | | | |
|---|---|---|---|
| 38-1715 | of 1963 | Japan . | |
| 55-145197 | 11/1980 | Japan | 204/35 N |

OTHER PUBLICATIONS

F. A. Lowenheim, *Electroplating*, McGraw-Hill Book Co., New York, 1978, pp. 12-13, 463-465.

W. Hubner et al., *The Practical Anodising of Aluminum*, McDonald and Evans, London, 1960, pp. 88-92.

*Primary Examiner*—John F. Niebling
*Assistant Examiner*—William T. Leader
*Attorney, Agent, or Firm*—Leydig, Voit & Mayer Ltd.

[57] ABSTRACT

A method of enhancing naturally developed color of an anodic oxidation coat on Al or Al alloy wherein the coat is formed by an electrolysis employing a warmed electrolyte containing at least sulfuric acid and an electric current of which the polarity is periodically reversed to be negative for a period less than 50% of each cycle while being applied to Al or Al alloy dipped in the electrolyte as anode for 20 to 40 minutes and the thus coated Al or Al alloy is subjected to a heat treatment in a boiling sealing liquid or a boiling metallic salt solution for 20 minutes. Preferably, the electrolysis is carried out for most of the electrolysis time with the current reversed for a small period of about 5% each cycle and during the terminating stage with the current reversed for a larger period of 30 to 35% each cycle. A sulfur compound is accumulated in the coat during such electrolysis and is combined with an added alloy element of the Al alloy during the heat treatment to further develop the color of the coat.

7 Claims, 6 Drawing Figures

ELECTROLYTICALLY PRODUCING ANODIC OXIDATION COAT ON AL OR AL ALLOY

This application is a continuation-in-part of application Ser. No. 308,099, filed 10-2-81, now abandoned.

This invention relates generally to methods for coloring anodic oxidation coat chemically produced on Al or Al alloy and, more particularly, to improvements in methods of the kind referred to in which a naturally developed color of the chemically produced coat is further developed and enhanced.

Generally, anodic oxidation coat chemically produced on Al alloy is porous so that it can be easily colored by utilizing its fine pores and is extensively utilized in ornamentals, machine parts, kitchenware, building materials and so on. In conventional coloring methods, however, an organic dye is merely adsorbed in the fine pores of the coat and there have been objections raised to such methods in that the colored coat is so low in resistance to weathering that it can not be utilized as a material for a part exposed to the sun and, in the case of a light color, the color will fade even if the alloy part having the coat is not exposed directly to sunlight.

For overcoming these objections, there have been suggested various methods as follows, but they still involve certain problems as will be detailed, respectively:

(1) Method of alloying: An alloy element which easily develops a color in an anodic oxidation is added in advance into an Al material so that the color will be naturally developed when the anodic oxidation coat is chemically produced. However, there are problems such as, in this case, the tone of the color developed by the added alloy element may be limited, the color will not develop unless the thickness of the coat is increased, and, while resistance to weathering can be improved by a thicker coat, it has been required to employ a higher voltage of more than 40 V for chemically producing the coat.

(2) Method using an electrolyte: An alloy element easily developing a color in an anodic oxidation coat is added in advance into an Al material and a special electrolyte easily developing a color when the anodic oxidation coat is chemically produced is used to improve the color developing efficiency to be higher than in the foregoing method (1). There are problems such as, in this case, though the color of this coat is high, resistance to the weathering is low, the electrolyte is more difficult to control and is more expensive than sulfuric acid or electrolyte containing sulfuric acid as is used in the method (1) further a higher electric voltage will be required when the anodic oxidation coat is chemically produced, and the tone of the developed color is limited as in the case of previously described method (1).

(3) Method using chromic acid: This is a method of chemically producing an anodic oxidation coat on an Al alloy by adding chromic acid into the electrolyte and properly adjusting the chemically producing voltage. The appearance of the coat is opaque and presents an enamel-like color tone but there have been problems that the coat is so thin (2 to 5 $\mu$m) as to lack mechanical durability. Further, since it is necessary to so adjust the chemically producing voltage as, for example, to be gradually elevated from 0 to 40 V during the first 10 minutes, to be maintained at 40 V during the next 20 minutes and to be held at 50 V during the last 5 minutes, there have been problems in that the adjusting operation is difficult, it is necessary to use a high voltage and, in addition, it is necessary to use chromic acid which is a difficult substance to work with.

(4) Ematal process: This is a method wherein a salt of Ti, Zr or the like is added into the electrolyte (oxalic acid) and an oxide of such metal is adsorbed in an anodic oxidation coat while being chemically produced at a chemically-producing voltage of 120 V. In this case, there are advantages in that the anodic oxidation coat is opaque and presents an enamel-like milky white tone, whereas problems have been involved in that a very high chemically-producing voltage and a costly metallic salt are required and the electrolyte in the electrolytic bath requires a complicated control.

(5) Secondary alternating current electrolysis method (Japanese patent application publication No. 1715/1963): An anodic oxidation coat is chemically produced on an Al material in an electrolyte of sulfuric acid or the like and is then subjected to an alternating current electrolysis in a solution containing a heavy metallic salt so as to be colored. In this case, the tone of the developed color is comparatively rich and, therefore, the method is most extensively utilized as a coloring method for building materials. However, there are problems in that the solution containing the heavy metallic salt, that is, the secondary electrolyte is so complicated in composition and the range of controlling the electrolyzing conditions of the secondary electrolysis is so narrow that the operation is difficult to control and the developed color tone is likely to fluctuate and, in order to obtain a product of many kinds of tones, electrolytic cells and current sources different for respective tones are required, whereby the equipment required is large and the equipment cost is high.

(6) Electric current reversing electrolysis method (Japanese patent application laid-open publication No. 145197/1980): While the polarity of an applied electric current is being periodically reversed to be negative, an Al material or Al alloy material dipped in an electrolyte containing sulfuric acid is subjected to a chemical production of an anodic oxidation coat and a sulfur compound is caused to be contained and accumulated in the anodic oxidation coat, after which the produced coat is dipped in a warmed metallic salt solution to be thereby colored. There are advantages in this method, as compared with the foregoing methods (1) to (5), in that the anodic oxidation coat can be colored simply by being dipped in the warmed metallic salt solution after the chemical production of the coat, a color of various kinds of tones can be developed by varying the metallic salt and current reversing conditions, only a dipping vessel is additionally required for the coloring and, consequently, expenses can be reduced. However, there are problems in that the metallic salt solution must be used to treat the anodic oxidation coat after its chemical production, thus the operation is difficult as involving a preparation of such solution, and the costs become high.

A primary object of the present invention is, therefore, to provide a method for enhancing naturally developed color of anodic oxidation coat chemically or electrochemically produced on Al or Al alloy, wherein naturally developed color of the anodic oxidation coat can be further developed in an easy and inexpensive manner.

Another object of the present invention is to provide a method for enhancing naturally developed color of anodic oxidation coat electrochemically produced on Al or Al alloy, wherein a selective color naturally developed of the coat can be easily enhanced in an inexpensive manner.

Still another object of the present invention is to provide a method for enhancing naturally developed color of an anodic oxidation coat chemically produced on Al or an Al alloy, wherein a coat high in resistance to weathering and color developing efficiency can be easily obtained even with a relatively small thickness.

A further object of the present invention is to provide a method for enhancing naturally developed color of an anodic oxidation coat on Al or an Al alloy wherein a primarily developed selective color of the coat can be easily and quickly enhanced at low costs while increasing the thickness of the coat.

Other objects and advantages of the present invention shall be made clear by the following descriptions of the invention detailed with reference to certain examples explained in conjunction with accompanying drawings, in which:

FIGS. 1A and 1B show examples of voltage wave forms used in the chemical production of anodic oxidation coat according to the present invention illustrating that the applied voltage is reversed for a period each cycle, wherein, specifically when the production is performed with different wave forms in the initial and terminating stages, FIG. 1A shows the wave form used in the initial stage of the chemical production when the voltage is reversed for a small period each cycle (which shall be hereinafter referred to as the primary chemical production stage) and FIG. 1B shows the wave form used in the terminating stage when the voltage is reversed for a longer period each cycle (which shall be hereinafter referred to as the secondary chemical production stage);

Figure 1A:
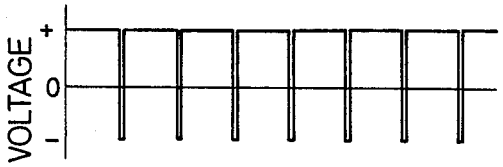
Figure 1B:
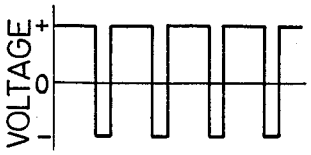
Figure 2A:
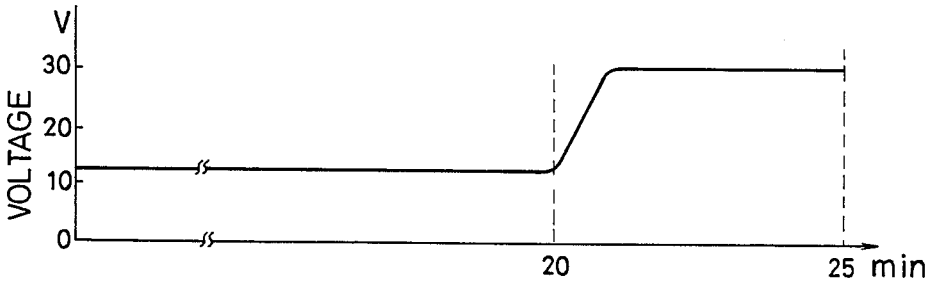
FIG. 2A is a diagram showing a large increase in magnitude of the applied voltage between the electrodes during the secondary stage of the chemical production of the anodic oxidation coat of the present invention.
Figure 2B:
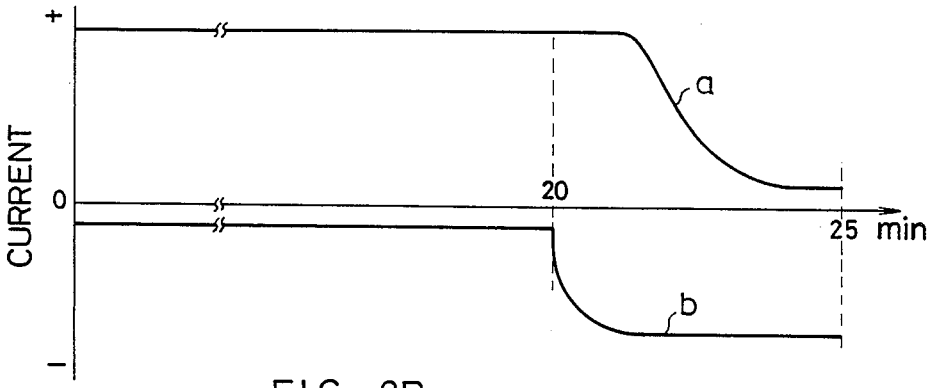
FIG. 2B is a diagram of the positive current component and the negative current component flowing between electrodes having a voltage applied between the electrode which is reversed for a period each cycle and showing a large increase in the negative current component when the applied voltage is reversed for a long period each cycle.

While the present invention shall now be detailed with reference to the examples, the intention is not to limit the invention only to these examples but is to rather include all modifications, alterations and equivalent arrangements possible within the scope of the appended claims.

EXAMPLE I

| | |
|---|---|
| Electrolyte: | 20% by weight sulfuric acid |
| Current conditions: | 13.3 Hz with a current reversed period of 15% each cycle |
| Positive current density: | 4A/dm$^2$ |

-continued

| | |
|---|---|
| Heating treatment: | Boiling water |

Under these conditions, the electric current was made to flow for 20 to 40 minutes by using carbon plates as opposed electrode to chemically produce a coat. The resultant coat was subjected to a heat treatment by dipping in boiling water, generally used for sealing, for 20 minutes. Color tones of thus treated coat were as in Table 1.

TABLE 1

| Aluminum alloys | Electrolyte temperature (°C.) | Chemically producing time 20 min | 30 min | 40 min |
|---|---|---|---|---|
| Al—Cu (5.6 wt %) | 15 | Light mossy | Mossy | Greenish brown |
| Al—Cu (4.5 wt %) | 15 | Light gold | Light mossy | Mossy |
| Al—Fe (1.4 wt %) | 20 | Dark gray | Light black | |
| Al—Mn (2 wt %)-Fe (1 wt %) | 25 | Bright gray | Dark grayish yellow | |
| Al—Co (1 wt %) | 25 | Gray | Grayish yellow | |

The tone varies with the kind and amount of the element added to the Al alloy. The tone proceeds further with the heat treatment and, the greater the coat thickness, the deeper the tone. The coat on the Al-Cu alloy is very light yellow as chemically formed but, when it is heated with boiling water, it becomes light mossy (with a coat thickness of 24 μm for a chemically producing time of 20 minutes) and greenish brown (with a thickness of 48 μm for a chemically producing time of 40 minutes) and, the higher the Cu content, the deeper the tone. The coat on the Al-Fe alloy is bright gray as chemically produced but, when it is heated with boiling water, it becomes dark gray (with a coat thickness of 24 μm for a chemically producing time of 20 minutes) and light black (with a thickness of 48 μm for a chemically producing time of 40 minutes) and, the higher the Fe content, the deeper the tone. The coat on the Al-Co alloy is light gray as chemically produced but, when it is heated with boiling water, it becomes gray (with a coat thickness of 24 μm for a chemically producing time of 20 minutes) and grayish yellow (with a thickness of 48 μm for a chemically producing time of 40 minutes) and, the higher the Co content, the deeper the tone.

EXAMPLE II

| | |
|---|---|
| Electrolyte: | 20% by weight sulfuric acid |
| Current conditions: | 18 Hz with a current reversed period 15% each cycle |
| Positive current density: | 4A/dm$^2$ |
| Heating: | Heated solution of nickel salt generally used for sealing |

Under these conditions, a coat was chemically produced in the same manner as in Example I and was dipped and heated in a solution of a nickel salt for 20 minutes. The tones of the coat at this time were as in Table 2. The tones of the Al-Cu alloy were substantially the same as in the case of Example I.

TABLE 2

| Aluminum alloys | Electrolyte temperature (°C.) | Chemically producing time 20 min | 30 min | 40 min |
|---|---|---|---|---|
| Al—Cu (5.6 wt %) | 15 | Light mossy | Mossy | Greenish brown |
| Al—Fe (1.4 wt %) | 20 | Dark gray | Black | |
| Al—Co (1 wt %) | 25 | Gray | Light black | |

The color tones of the Al-Fe alloy and Al-Co alloy were deeper than in the case of Example I and were blackish. It is found that, in this case, the anodic oxidation coat of the Al alloy could be enhanced in its naturally developed color in the same manner as in Example I and further the pores could be sealed.

EXAMPLE III

| | |
|---|---|
| Electrolyte: | 20% by weight sulfuric acid |
| Current condition: | 13.3 Hz |
| Positive current density: | 4A/dm$^2$ |
| Chemically producing time: | 20 minutes |

Under these conditions, an anodic oxidation coat was chemically produced on an Al alloy developing its color by varying as indicated in Table 3 the current reversed period and, as a result, the negative current component, each cycle. At this time, the coat was heated by utilizing boiling water or the heated solution of nickel salt (used in Examples I and II). The results of the experiments were as in Table 3.

TABLE 3

| Aluminum alloys | Heating Liquid | Reversing rate 10% | 15% | 20% |
|---|---|---|---|---|
| Al—Cu (4.5 wt %) | Heated Ni Salt Sol. | — | Light gold | Light yellowish green |
| Al—Fe (1.4 wt %) | Heated Ni Salt Sol. | Gray | Dark gray | Light black |
| Al—Co (1 wt %) | Heated Ni Salt Sol. | — | Gray | Dark gray |
| Al—Co (1 wt %) | Boiling water | — | Gray | Grayish yellow |

When the current reversed period each cycle was varied, the tone of the coat of each Al alloy varied. That is, in the case when the reversed period each cycle was shorter, the tone was light. When the reversing period each cycle was longer, the tone was deep. The longer the reversed period each cycle, the larger the negative current component and, therefore, the more the sulfur compound contained and accumulated in the coat and reacting with the metal in the coat. Therefore, the tone of the coat is deep. Accordingly, it is found that, by varying the reversed period each cycle of the electric current, the negative current component at the time of chemically producing the anodic oxidation coat can be adjusted and the tone can be varied and adjusted.

EXAMPLE IV

| | |
|---|---|
| Electrolyte: | 20% by weight sulfuric acid |
| Electrolyte temperature: | 20° C. |
| Current condition: | Reversed period each cycle of 15% |
| Positive current density: | 4A/dm$^2$ |
| Chemically producing time: | 20 minutes |

Under these conditions, an Al alloy of Al-Fe (1.4 wt%) was used, the frequency (Hz) of the used current was varied and the variation of the tone of resultant coat was investigated. At this time, after the coat was chemically produced, it was heated for 20 minutes in a sealing liquid kept at 95° C. The results of the experiments were as in Table 4.

TABLE 4

| Current frequency (Hz) | 0 | 20 | 60 | 100 | 200 |
|---|---|---|---|---|---|
| Tone | Bright gray | Dark gray | Dark gray | Dark gray | Gray |
| Coat thickness (μm) | 21.3 | 24.1 | 22.5 | 21.8 | 17.9 |
| Coat hardness (Hv) | 346 | 401 | 355 | 341 | — |

When the current frequency was 0 Hz, that is, in the direct current electrolysis, the chemically produced coat was naturally developed bright gray without being heated but, even when the coat was thereafter heated, the tone did not vary. In the case when the current frequency was 20 to 100 Hz, dark gray was presented when the chemically produced film was heated. By variation of the current frequency, no variation of the tone of the chemically produced coat was seen. When the current frequency was above 200 Hz, the coat thickness of the chemically produced coat became small and the tone became light. The coat thickness and hardness of the chemically produced coat could be generally made larger by the alternating current electrolysis, that is, the current reversing electrolysis, than in the case of the direct current electrolysis. Therefore, it is found that, according to the present invention, a high quality anodic oxidation coat can be chemically produced and its color naturally developed can be well enhanced.

EXAMPLE V

| | |
|---|---|
| Electrolyte: | 35% by weight sulfuric acid + 10 g/l of oxalic acid |
| Electrolyte temperature: | 15° C. |
| Current conditions: | 13.3 Hz with Reversed period each cycle of 15% |
| Positive current density: | 4A/dm$^2$ |
| Heating: | Boiling water |

Under these conditions, a coat was chemically produced in the same manner as in Example I and was then dipped and heated for 20 minutes in boiling water. The tone of the coat at this time was as in Table 5.

TABLE 5

| Aluminum alloys | Chemically producing time (Thereafter heat-treated) 20 min | 30 min | 40 min |
|---|---|---|---|
| Al—Cu (4.5 wt %) | Light gold | Light yellowish green | Light mossy |
| Al—Cu (5.6 wt %) | Light yellowish green | Light mossy | Mossy |

Even when the electrolyte was a mixture of sulfuric acid and oxalic acid, the coat could be chemically produced in the same manner as in the case that only sulfuric acid was used for the electrolyte and the tone was substantially the same. Therefore, it is found that, if sulfuric acid is contained in the electrolyte, the coat can be favorably chemically produced and while its naturally developed color can be further enhanced in tone by varying the chemically producing time.

In the foregoing Examples I to V, the current reversed period each cycle has not been changed during the chemical coat production. As will be clear from further Examples VI to X described in the followings, the present invention achieves more efficiently the chemical production and color enhancing of the anodic oxidation coat by varying the reversed period each cycle at respective initial and terminating stages of the chemical production.

When the chemical production of the anodic oxidation coat on Al or an Al alloy in the present invention was carried out in an electrolyte containing an inorganic acid or organic acid by using a reversing current, there were such relations as in Table 6 between the reversed period each cycle, that is, the time width of the negative current pulse each cycle, and the hardness and thickness of the coat:

TABLE 6

| Reversed Period (%) | 0 | 5 | 15 | 25 | 35 |
|---|---|---|---|---|---|
| Coat hardness (Hv) | 354 | 416 | 412 | 384 | 352 |
| Coat thickness (μm) | 36.4 | 36.5 | 35.1 | 29.4 | 14.1 |

Table 6 shows that, the longer the reversed period each cycle, the less the hardness and thickness of the coat. In the case of such material on which a compact coat is easy to produce as pure Al or an anticorrosive Al alloy, having the reversed period each cycle longer than 25% resulted in the positive current component becoming so large that the chemically producing voltage rose and no coat thicker than a fixed thickness could be chemically produced. Therefore, in the present invention, the chemical production of the anodic oxidation coat is carried out primarily with an electric current of a short reversed period each cycle (including a reversed period of zero duration, that is, direct current) and then the chemical production is carried out secondarily with an electric current of a longer reversed period each cycle in the same electrolytic bath, that is, the same electrolyte, to chemically produce the coat of a sufficient thickness and hardness and then the coat is varied in the microstructure so as to enhance naturally developed color of the coat. In the present invention, further, a sulfur compound is accumulated in the coat in the secondary chemical production and is combined with a metal element added in advance into the Al alloy or addded in a subsequent heat treatment so as to be colored. It will be clear that such metal elements as Ni, Co, Ag, Fe, Cu, Pb and the like can be utilized.

EXAMPLE VI

| | |
|---|---|
| Electrolyte: | 20% by weight sulfuric acid |
| Electrolyte temperature: | 25° C. |
| Current condition: | 13.3 Hz |
| Positive current density: | 4A/dm$^2$ |
| Primary chemical production conditions: | Reversed period each cycle of 5% for 20 minutes |
| Secondary chemical production condition: | Reversing rate of 35% |
| Maximum chemically producing voltage: | 30 V |

Under these conditions, an anodic oxidation coat was chemically produced on an Al material with a carbon plate as an opposed electrode. A coat of a high hardness was chemically produced in the primary chemical production and then the secondary chemical production was carried out by extending the reversed period each cycle in the same electrolytic bath, that is, in the same electrolyte. When the maximum value of the chemically producing voltage was raised to 30 V, the coat has developed its color to be opaque as in Table 7 depending on the Al material and secondary chemical production time. Even when the secondary chemical production time was 3 minutes, as evident from Table 7, the color has developed and, as the secondary chemical production time became longer, the degree of the color development has further advanced. Even when the maximum value of the chemically producing voltage was made 50 V, the tone of the coat was substantially the same as in the case of 30 V. Therefore, it is found that, when the reversed period each cycle is increased in the course of the chemical production, a well colored anodic oxidation coat of a high hardness will be obtained.

TABLE 7

| | Secondary chemical production time | | |
|---|---|---|---|
| Al materials* | 3 min | 5 min | 10 min |
| 3003 | Ivory | Beige | Deep beige |
| 6061 | Light grayish yellow | Grayish yellow | Deep grayish yellow |
| 6063 | Ivory | Light beige | Beige |
| 5052 | Light beige | Beige | Grayish yellow |

*Standard identification of Aluminum Association of America, throughout the following Tables.

EXAMPLE VII

| | |
|---|---|
| Electrolyte: | 20% by weight sulfuric acid |
| Electrolyte temperature: | 25° C. |
| Current condition: | 18 Hz |
| Positive current density: | 4A/dm$^2$ |
| Primary chemical production condition: | Reversed period each cycle of 7% |
| Secondary chemical production conditions: | Reversed period each cycle of 30% for 5 minutes |
| Maximum chemically producing voltage: | 30 V |

Under these conditions, a coat was chemically produced in the same manner as in the case of Example VI. The tone of the coat varied as shown in Table 8 depending on the primary chemical production time. In the case when the primary chemical production time was short, that is, the primary coat was thin, it tended to take a long time until the chemically producing voltage reached the maximum value of 30 V in the secondary chemical production.

TABLE 8

| | | Primary chemical production time | | |
|---|---|---|---|---|
| Al materials | | 10 min | 20 min | 30 min |
| 6063 | Tone | Ivory | Beige | Thick beige |
| | Thickness (μm) | 12.4 | 24.5 | 37.0 |
| 6061 | Tone | Light grayish yellow | Grayish yellow | Thick grayish yellow |
| | Thickness (μm) | 12.2 | 24.6 | 37.1 |
| Al—Fe (1.4 wt %) | Tone | Bright gray | Gray | Dark gray |
| | Thickness (μm) | 12.4 | 23.9 | 36.5 |

When the primary chemical production time was, for example, 10 minutes, an opaque color developed with the secondary chemical production time of about 4 minutes. Further, even when the primary chemical production time was 5 minutes and the coat thickness was about 6 μm, the chemically producing voltage could be raised within a short time to enhance the primarily developed color, if the reversed period each cycle at the time of the secondary chemical production was further increased. Therefore, it is found that, if the primarily chemically produced coat is thick, it will be able to enhance its developed color by the secondary chemical production for a certain time and that, if the primary chemically produced coat is thin, it will be able to also enhance developed color within a short time by increasing the reversed period during the secondary stage chemical production. It is also found that the larger the coat thickness of the primary chemically produced coat, the deeper the colored tone. Also, it is found that various tones can be obtained depending on the composition of the Al material and that, for example, if Fe is contained, a grayish tone will be made and, if small amounts of Si and Mg are contained as in the 6063 alloy, a beigish tone can be developed.

EXAMPLE VIII

| | |
|---|---|
| Electrolyte: | 35% by weight sulfuric acid + 10 g/l of oxalic acid |
| Electrolyte temperature: | 25° C. |
| Current condition: | 13.3 Hz |
| Positive current density: | 4A/dm$^2$ |
| Primary chemical production condition: | Reversed period each cycle of 5% |
| Secondary chemical production condition: | Reversed period each cycle of 30% for 5 minutes |
| Maximum chemically producing voltage: | 30 V |

Under the conditions, a coat was chemically produced in the same manner as in Example VII. The results were a in Table 9:

TABLE 9

| | Primary chemical production time | | |
|---|---|---|---|
| Al materials | 5 min | 10 min | 20 min |
| 3003 | Ivory | Beige | Grayish yellow |
| 6063 | Light ivory | Ivory | Beige |

Even when a mixture of sulfuric acid and oxalic acid was used for the electrolyte, the coat could develop a color substantially in the same tone as in the case of using only sulfuric acid for the electrolyte. When such organic acid as oxalic acid was added in the electrolyte, the chemically producing voltage could be easily raised by the secondary chemical production even if the primary chemically produced coat was thin. Therefore, it is found that, even if an organic acid other than sulfuric acid is added in the electrolyte, the developed color of the coat can be further enhanced and, in addition, the time required for the respective primary and secondary chemical productions can be reduced if an organic acid is added.

EXAMPLE IX

| | |
|---|---|
| Electrolyte: | 20% by weight sulfuric acid |
| Electrolyte temperature: | 25° C. |
| Current condition: | 13.3 Hz |
| Positive current density: | 4A/dm$^2$ |
| Primary chemical production conditions: | Reversed each cycle of 5% for 20 minutes |
| Secondary chemical production conditions: | Reversed each cycle of 30% for 5 minutes |
| Maximum chemically producing voltage: | 30 V |

Under the conditions and in the same manner as in Examples VI and VII, an anodic oxidation coat was chemically produced by the primary and secondary chemical productions and was thereafter dipped for 20 minutes while boiling in a solution containing 20 g/l of nickel sulfate and thereafter in a sealing liquid containing a nickel salt. The results were as shown in Table 10. When the thus chemically produced coat was heated in a metallic salt solution and thereafter in a sealing liquid containing a metallic salt, the sulfur compound contained and accumulated in the coat by the reduction of the sulfuric acid electrolyte at the time of the chemical production reacted with the metal ions to make the tone deeper than in the case of the color naturally developed merely by the chemical production.

TABLE 10

| | | Heating | |
|---|---|---|---|
| Al materials | Not heated | Nickel sulfate solution | Sealing liquid containing Ni salt |
| 6063 | Beige | Very dark grayish yellow | Dark gray |
| Al—Fe (1.4 wt %) | Gray | Dark gray | Dark gray |
| Al—Co (1.0 wt %) | Beige | Gray | Dark gray |

Therefore, it is found that a compound tone of the color developed by the metal salt in addition to the opaque color naturally developed by the primary and secondary chemical productions can be attained. It is also found that, even if the primary chemical production is made with a direct current, the tone will not substantially vary.

EXAMPLE X

| | |
|---|---|
| Electrolyte: | 20% by weight sulfuric acid |
| Electrolyte temperature: | 25° C. |
| Current condition: | 18 Hz |
| Positive current density: | 4A/dm$^2$ |
| Primary chemical production conditions: | Reversed period each cycle of 7% for 20 minutes |
| Secondary chemical production conditions: | Reversed period each cycle of 35% for 5 minutes |
| Maximum chemically producing voltage: | 30 V |
| Al material (alloy): | Al-Mn (2 wt %)-Fe (1 wt %) |

Under the conditions, an anodic oxidation coat was chemically produced and was heated in various metal salt solutions to enhance the naturally developed color of the coat. The metal salt solution was maintained at the boiling point and the coat was heated as dipped in the solution for 20 minutes, then such tones as in Table 11 were thereby attained:

TABLE 11

| Metallic salt solution | Tone |
|---|---|
| 20 g/l of cobalt sulfate | Dark gray yellowish red |
| 5 g/l of copper nitrate | Deep green |
| 2 g/l of lead acetate | Cocoa |

A chemically producing current of a frequency of 18 Hz was used but, even in the case of 13.3 Hz, substantially the same results were obtained. It is found that the color and tone can be selected as desired depending on the composition of the metallic salt solution. When the reversed period each cycle in the secondary chemical production was made longer, the color or tone was not seen to vary even if the time was reduced.

Generally, however, as the foregoing examples suggest, it is preferred to conduct the primary stage of the described process with the current having a reversed period in each cycle of about 5 percent to about 7 percent for between about 10 and about 30 minutes and the second stage of the process with the current having a reversed period of about 30 percent to about 35 percent for between about 3 to about 10 minutes.

The coloring method of the present invention is evaluated as follows on the basis of the foregoing Examples I to X:

(1) A naturally developed color of an anodic oxidation coat chemically produced on Al alloy in an electrolyte containing at least sulfuric acid can be well enhanced only by heating. Such heating means as boiling water, a heated sealing liquid or the like can be utilized and proper extensive heating means can be utilized. When the sealing liquid is used for the heating, the heating and sealing treatments can be simultaneously carried out and required equipment and operation can be simplified.

(2) The color tone can be varied by selecting and adjusting the kind and content of alloy element added to the Al material, that is, the component element of the Al alloy. The added metallic element contributing to the coloring at this time is uniformly distributed in the entire coat and a uniform tone can be attained.

(3) By adjusting the reversed period each cycle of the electrolyzing current and the chemically producing time, the accumulation of the sulfur compound in the coat can be adjusted and the color tone can be properly selected. Further, as the sulfur compound is made to react with the metallic ions in the coat by heating, a stable tone high in resistance to weathering can be attained. Further, it is preferable that the reversed period each cycle is less than about 50% because, if the reversed period each cycle exceeds 50%, speed of the chemically producing the anodic oxidation coat will be low. Further, the longer the chemically producing time, the greater the coat thickness and, therefore, the deeper the color tone. It is also preferable that the reversed period of each cycle be more than about 5 percent.

(4) Metallic salt solution needs not be used as a coloring means and, therefore, there is no difficulty in treating the waste liquid. The equipment can be made inexpensively without needing any special coloring means.

(5) In chemically producing an anodic oxidation coat on Al or an Al alloy in a simple and inexpensive electrolyte containing sulfuric acid, an opaque color can be developed in the coat only by increasing the reversed period each cycle at least during the terminating stage of the chemical production.

(6) The chemically producing voltage can be reduced to a lower value and electric power consumption can be less to than in conventional natural color developing methods using a special electrolyte high in cost and difficult to control. In addition, the voltage control can be simplified.

(7) As the current reversed period each cycle is increased during the terminating stage of the chemical production of the coat and a large amount of a sulfur compound can be accumulated in the coat, the coat color can be well developed in the subsequent heating treatment even if the coat is thin.

(8) The color development achieved by the subsequent heating treatment can be superposed on the color naturally developed at the time of the chemical production of the coat and various tones can be thereby realized.

(9) As the current reversed period each cycle can be made short except in the terminating stage of the chemical production of the coat, excellent mechanical properties of the coat can be well maintained.

(10) A suitable value for the frequency of the current is about 13.3 to about 200 Hz.

Figure 3:
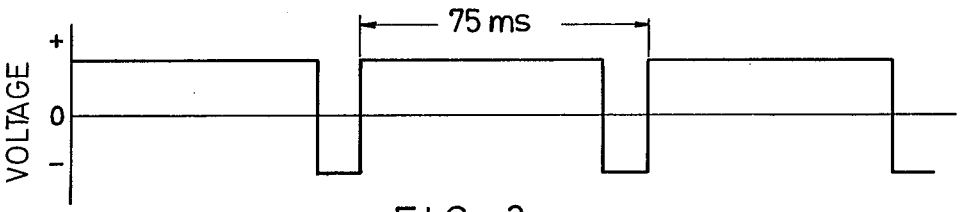
FIG. 3 is a diagram similar to FIG. 1A and shows another example of the voltage wave form used to chemically produce the anodic oxidation coat of the present invention.
Figure 4:
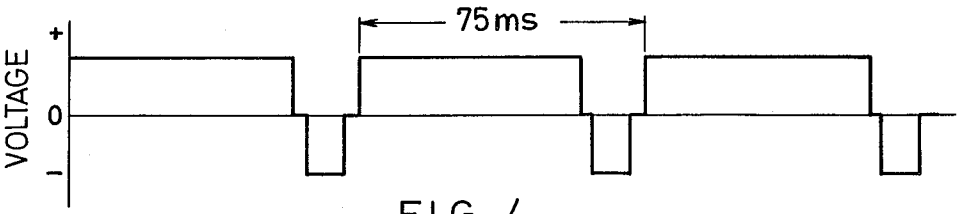
FIG. 4 is a diagram similar to FIG. 3 and shows a still another example of the voltage wave form used in the present invention.

(11) A current which is reversed immediately may be used, such as that shown in FIG. 3. However, when using this type of current, a switching means which provides a highly responsive circuit must be employed, such as an inverter circuit having a diode. This arrangement is both complicated and expensive and the reversal of polarity becomes difficult due to the large current generally employed and potential danger of damaging the semiconductor element. However, the inclusion of a rest period in which the voltage is zero permits a simplification of the circuit and reduces expense. Preferably, a rest period both precedes and follows the revsed period of each cycle, such as that shown in FIG. 4. As the switching element, the circuit may include a thyristor which is capable of withstanding large currents. By interposition of such rest periods, polarization can be effectively prevented and the voltage suitable for producing a chemical coating can be lowered. This results in optimization and increased stability of the coating in contrast to that which results when current of the type illustrated in FIG. 3 is used.

What is claimed as our invention is:

1. A method for enhancing the naturally developed color of an anodic oxidation coating on the surface of an Al alloy material having at least one alloying element which forms a color compound in the presence of a sulfur compound during electrochemical production of said oxidation coating, the method comprising the steps of:

(a) electrochemically oxidizing the surface of the Al alloy material to form an oxide coating by performing a first step of electrolysis in a sulfuric acid-containing electrolyte utilizing an alternately reversed current having a reversed period each cycle of less than 50 percent and more than about 5 percent in said electrolyte, and (b) enhancing the color of the coating by performing a second step of electrolysis within said electrolyte by means of an alternately reversed current having a longer reversed period each cycle than that utilized in step (a), said first and second stages being conducted with a current having a frequency of between about 13.3 Hz to about 200 Hz and with a rest period preceding and following tthe reversed period of each cycle.

2. A method according to claim 1 wherein said electrolyte is an aqueous solution of about 20 percent by weight sulfuric acid, said first step of electrolysis is performed with current having a reversed period of about 5 percent to about 7 percent for between about 10 to about 30 minutes, and said second step of electrolysis is performed with current having a reversed period of about 30 percent to about 35 percent for between about 3 to about 10 minutes.

3. A method according to claim 2 which further comprises a step of heating said Al alloy material subsequent to said step (b) at least in a boiling metallic salt solution for about 20 minutes.

4. A method according to claim 3 wherein said metallic salt solution is selected from a group consisting of about 20 g/l cobalt sulfate, about 5 g/l copper nitrate and about 2 g/l lead acetate solutions.

5. A method according to claim 3 wherein said heating step is performed in said boiling metallic salt solution and then in a boiling sealing liquid containing nickel salt.

6. A method according to claim 5 wherein said metallic salt solution is a nickel sulfate solution.

7. A method according to claim 1 wherein said electrolyte is an aqueous solution of about 35 percent by weight sulfuric acid and about 10 g/l oxalic acid, said fist step of electrolysis is performed with current having a reversed period of about 5 percent for about 5 to about 20 minutes, and said second step of electrolysis is perfomed with current having a reversed period of about 30 percent for about 5 minutes.

* * * * *